US006368050B1

(12) United States Patent
Currie et al.

(10) Patent No.: US 6,368,050 B1
(45) Date of Patent: Apr. 9, 2002

(54) FORK LIFTS

(76) Inventors: Stephen Henry Currie; James Robert Currie, both of 1416 Omahu Road, Hastings (NZ)

( * ) Notice: Subject to any disclaimer, the term of this patent is extended or adjusted under 35 U.S.C. 154(b) by 0 days.

(21) Appl. No.: 09/581,096

(22) PCT Filed: Dec. 8, 1998

(86) PCT No.: PCT/NZ98/00180

§ 371 Date: Jun. 7, 2000

§ 102(e) Date: Jun. 7, 2000

(87) PCT Pub. No.: WO99/29617

PCT Pub. Date: Jun. 17, 1999

(30) Foreign Application Priority Data

Dec. 8, 1997 (NZ) ..... 329351

(51) Int. Cl.[7] ..... B66C 3/00

(52) U.S. Cl. ..... 414/785; 414/607; 187/237

(58) Field of Search ..... 414/607, 642, 414/686, 785; 187/237; 248/649, 653, 654, 676, 677

(56) References Cited

U.S. PATENT DOCUMENTS

| | | | | |
|---|---|---|---|---|
| 6,142,724 A | * | 11/2000 | Hirooka et al. | 414/686 |
| 6,231,295 B1 | * | 5/2001 | Girstenbrei et al. | 414/686 |
| 6,247,888 B1 | * | 6/2001 | Guiet | 414/686 |

FOREIGN PATENT DOCUMENTS

| | | |
|---|---|---|
| AU | 43947/89 | 5/1990 |
| DE | 1 406561 | 9/1975 |
| EP | 0283637 | 9/1988 |

* cited by examiner

*Primary Examiner*—Joseph E. Valenza
(74) *Attorney, Agent, or Firm*—Blakely Sokoloff Taylor & Zafman

(57) ABSTRACT

A fork lift tine construction is disclosed which includes a tine (11) and a tine mounting (12). The tine mounting (12) is characterised in that it includes at least one open area (A) through which the tip of the tine may be seen when viewed from the other side of the tine mounting (12). The construction aids in visibility of the tine for a fork lift operator and therefore offers greater accuracy.

7 Claims, 3 Drawing Sheets

FORK LIFTS

BACKGROUND TO THE INVENTION

The present invention relates to improvements in fork lifts.

Fork lifting arrangements as found on specialised vehicles or fitted to tractors and the like can have inherent visibility problems for the operator when approaching a load to be lifted and relocated.

Often the vertical walls of the L-shaped fork can obscure the view of the surface and tip of the fork as it encounters the load pick up points. This loss of visual contact causes inaccuracy which can lead to damage to goods, dangerously positioning the articles to be moved, longer operational times and other factors.

A further problem encountered with fork lift arrangements, particularly when retrofitted to work vehicles such as tractors or trucks is the difficulty in removing the actual fork lift arrangement itself. It may be necessary for the fork lift/frame arrangement to be removed for servicing or storage or to be refitted at the rear of the vehicle or on another vehicle. Commonly a second fork lift vehicle must be used to lift the arrangement off the first vehicle in addition to intensive man-handling. Fitting a fork lift arrangement back on a vehicle can be even more tedious as holes must be accurately lined up for locating pins and bolts etc. which secure the arrangement in place.

SUMMARY OF THE INVENTION

It is an object of the present invention to provide a fork lift construction whereby better visibility is achievable. The meeting of this objective will enable the forks and more preferably the fork tips to be more readily seen by the vehicle operator when approaching a load to be lifted.

In a broad aspect of the invention there is provided a fork lift tine construction including a tine and a tine mounting from which the tine extends, the tine mounting including at least one open area through which the distal end of the tine can be seen when viewed from that side of the tine mounting opposite to that from which the tine extends.

It is another object of the present invention to provide a fork lift construction which can be removed from a host vehicle in a convenient manner.

In a second broad aspect of the invention there is provided a fork lift arrangement including a first pivoting member adapted to pivot from the fork lift arrangement said first member having a ground engagement means, a second member extending pivotally from a position in the length of the first member and adapted to be connectable with an actuator of the fork lift arrangement whereby the first member under control of the actuator applies a force to the first member to thereby cause fork lift arrangement to move from its mounting on a vehicle.

DETAILED DESCRIPTION OF THE PREFERRED EMBODIMENT OF THE INVENTION

Figure 1:
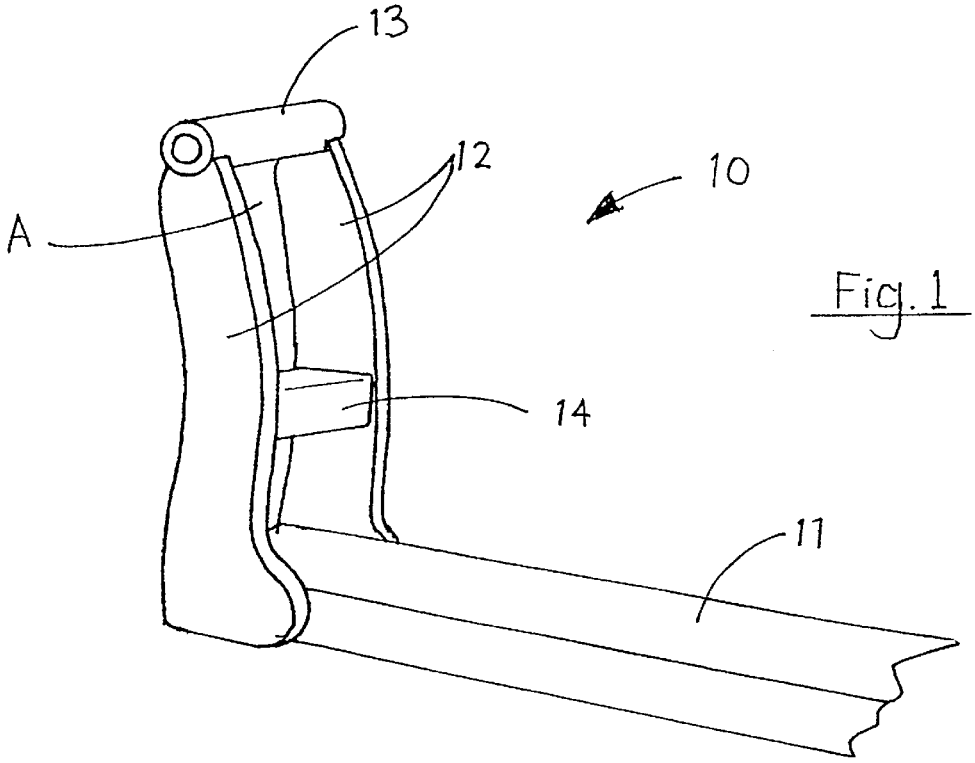
FIG. 1 is a general view of a single tine construction according to the invention.
Figure 2:
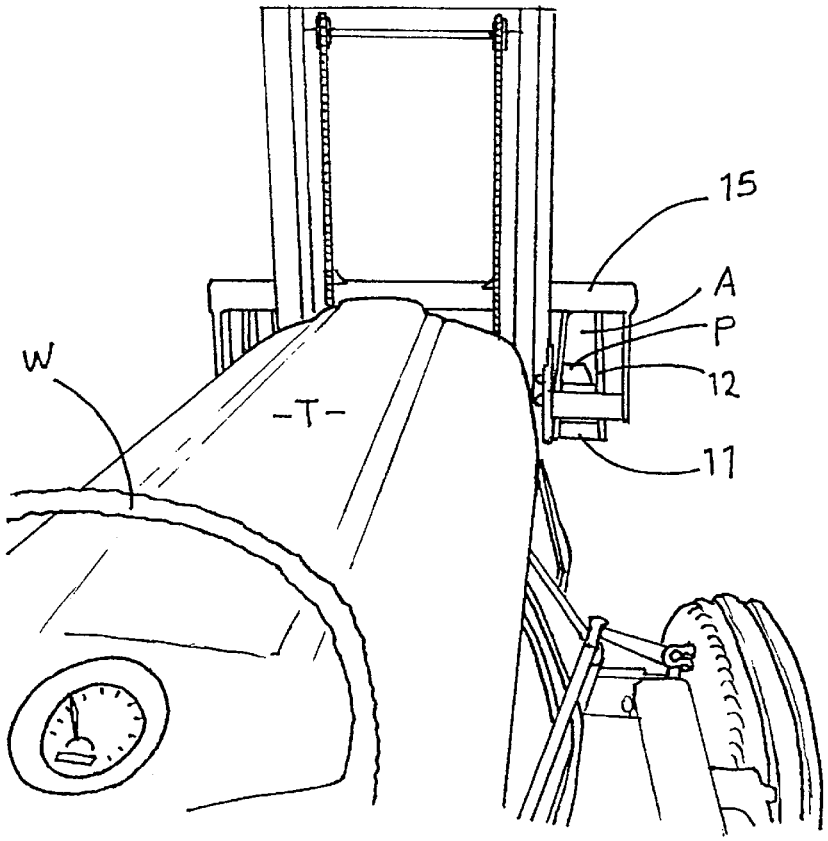
FIG. 2 is a view from the perspective of a fork lift operator using the fork from FIG. 1.

According to the present invention there is provided a fork lift tine construction whereby the tines, but more particularly the tine tips, can be seen by the vehicle or fork lift operator. FIGS. 1 and 2 illustrate a preferred fork lift construction where this is possible.

FIG. 1 illustrates a single substantially L-shaped tine construction 10, comprised of a load bearing tine 11 (partially cut away in FIG. 1) and a mounting formed by two side walls 12 which extend substantially perpendicularly from tine 11 toward a cylindrical bearing sleeve 13.

Located at a mid point between the two side walls 12 is a brace element 14 to give additional strength and support at the contact point with lift frame 15 (seen in FIG. 2).

Lift frame 15 is a known design, however, it must provide an unobscured view (as seen in FIG. 2) in order to be used with the present invention.

All tine construction 10 components are preferably constructed from steel and welded to one another accordingly for the highest strength to weight qualities possible.

Unlike conventional fork lift arrangements, the sidewalls 12 provide between them a 'see-through' gap A. This gap A is not present in conventional designs because the conventional perpendicular support element (which has been replaced by side walls 12) was a solid construction extending from tine 11 to the attachment point (bearing sleeve 13).

The tine construction 10 of the present invention can be coupled to the lift frame 15 in a standard way. Bearing sleeve 13 is commonly fitted to a shaft (not seen in FIG. 2) on the lift frame 15. Forks often have a degree of lateral movement to allow them to be repositioned for varying load sizes and have pivotal movement about the bearing sleeve 13 so they can be stowed away above and behind lift frame 15.

FIG. 2 illustrates the tine construction 10 in use from the perspective of an operator sitting behind the drivers wheel W of a tractor T. Gap A between the side walls 12 allows an unobscured view of the tip P of tine 11. In conventional designs, gap A is not present and the exact position of tip P is a mystery to the operator.

The advantage in vision for the operator can allow better judgement of distance and more control of the tines 11 as the fork lift approaches a load to be lifted.

The net effect of the improved tine construction 10 is to increase the speed with which loads can be engaged and also reduce damage to loads through puncturing or other exterior battering.

Figure 3:
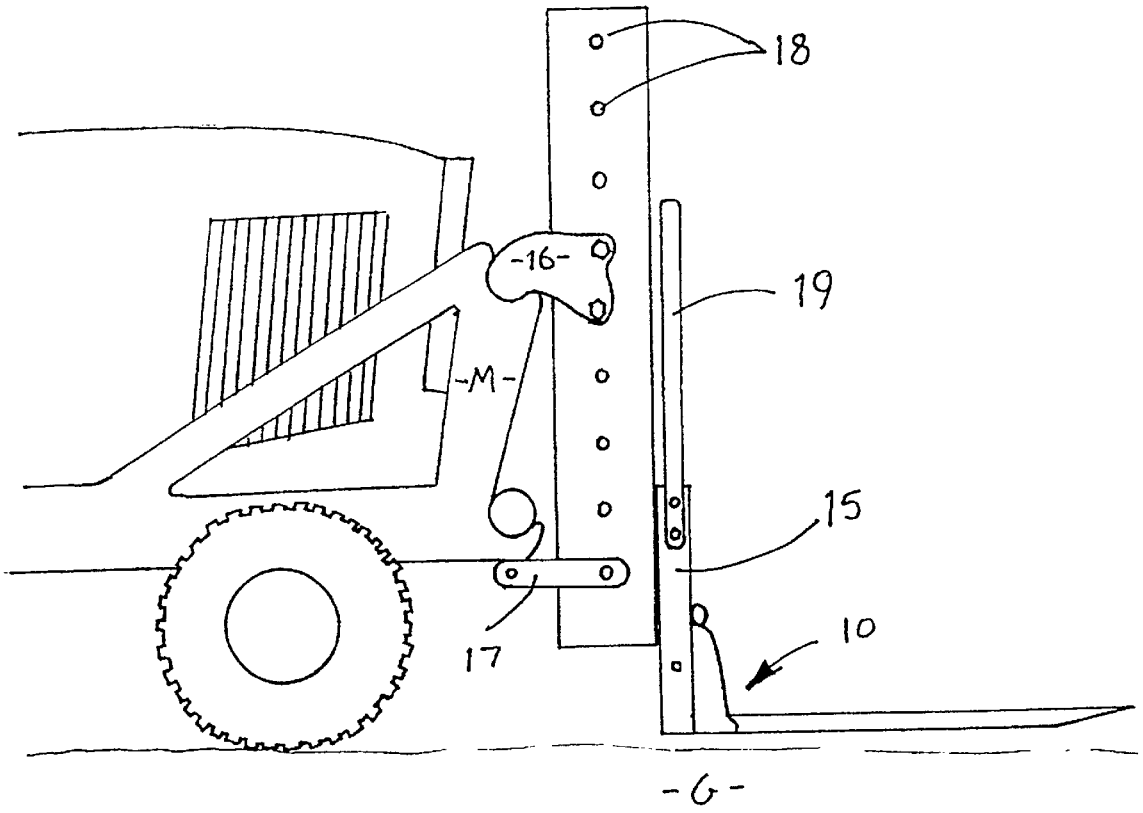
FIG. 3 is a side view of the mounting arrangement according to the invention.
Figure 4:
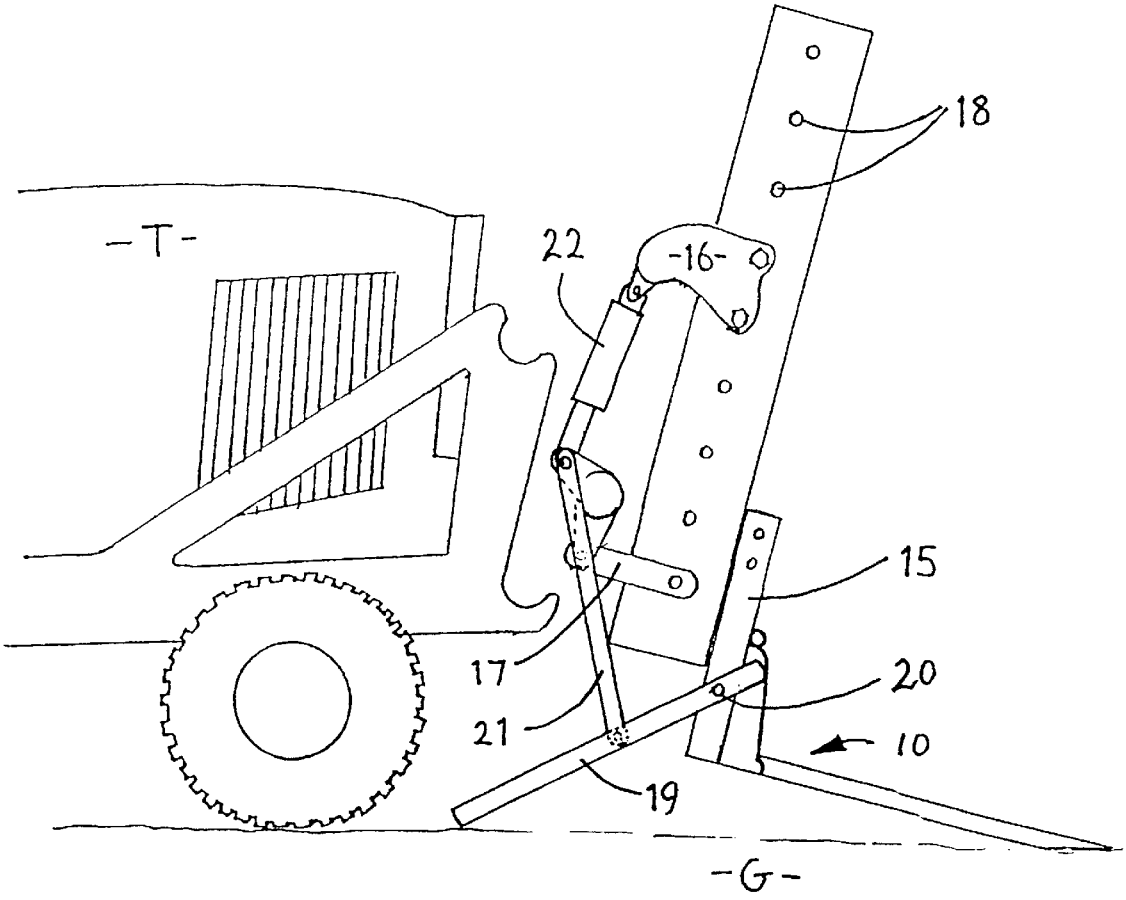
FIG. 4 is a side view of the second step in the process of removing the fork lift arrangement as illustrated in FIG. 3.

A further feature of the overall improved fork lift arrangement is illustrated by FIGS. 3 and 4 where the hydraulic tilting mechanism of the fork lift can be utilised to create a 'self lifting' aspect to the entire fork lift arrangement.

In normal use the fork lift appears as illustrated in FIG. 3. Mounting brackets 16 (upper) and 17 (lower) on each side of the fork lift are engaged with the tractor mount M and releasably attached.

Brackets 16 and 17 have been bolted to the outer frame which in turn is coupled to an inner frame which includes the grooves for running the lift frame 15 up and down. The bolting of brackets 16 and 17 represents an improvement over conventional welding which has a tendency to distort the outer frame and bow it out from the inner frame (not seen).

In addition to this, the plurality of mounting holes 18 allows some flexibility in the positioning of brackets 16 and 17 (not available if the brackets are welded).

Also present upon the mobile lift frame 15 section of the fork lift is a safety load frame 19 which is fastened to each side of the lift frame 15 with bar(s) extending therebetween (not seen in the side elevation view).

When it is desired to remove the fork lift arrangement for e.g. maintenance or to attach it to another vehicle the tilt mechanism can be employed to effect self removal. FIG. 4 illustrates the procedure.

The safety load frame 19 is removed from lift frame 15 and pivotally reattached at a lower point 20 on the lift frame and extends back toward tractor T to contact the ground G. A further connecting bar 21 is pivotally attached at a midpoint of the load frame 19 and also pivotally attached to the lower pivotal coupling of hydraulic cylinder 22 (which is normally used to effect the forward and backward tilting of the fork lift for carrying and picking up loads).

The single directional extending motion of hydraulic cylinder 22 acts upon connecting bar 21 which in turn uses the ground leverage created by load frame 19 to lift the entire fork lift arrangement off the tractor mount M. The tractor T can then be backed away and all power couplings disconnected. Power couplings are generally a series of hydraulic hoses, not illustrated here for clarity.

The reverse process described above can be used to reattach the fork lift arrangement when necessary.

The 'self lifting'process described eliminates the need to use a second fork lift for removal of the first arrangement. Also the simple tractor mount M which couples to the fork lift eliminates the manual effort of lining up bushes for the connecting pins common to other fork lift designs.

It will be appreciated by those skilled in the art that a number of alternative embodiments may be possible to achieve the object of the invention.

Further embodiments include using a single sidewall 12 (generally thicker gauge steel to the existing side wall 12 illustrated) thus eliminating the need for the bracket 14 or other side wall. Such an embodiment is likely to have less strength than the preferred embodiment.

The fork lift of the present invention provides a significant improvement over conventional fork lift designs and allows higher accuracy in use and convenient removal after use.

What is claimed is:

1. A fork lift tine construction including a tine (11) and a tine mounting (12) from which the tine (11) extends, the tine mounting (12) including at least one open area (A) through which the distal end (P) of the tine (11) can be seen when viewed from that side of the tine mounting (12) opposite to that from which the tine (11) extends.

2. A tine construction as claimed in claim 1 wherein the tine mounting (12) includes a mounting element (13) spaced from the join of the tine (11) with the tine mounting (12).

3. A tine construction as claimed in claim 1 wherein the tine mounting (12) includes a pair of spaced apart members which extend from the tine (11) to a mounting element (13).

4. A tine construction as claimed in claim 2 wherein a pair of spaced apart substantially parallel elongate members (12) extend from the mounting element (13) toward the join of the tine (11) with the tine mounting.

5. A tine construction as claimed in claim 3 wherein at least one bracing element (14) is provided between said spaced apart members (12).

6. A tine construction as claimed in claim 2 wherein the mounting element (13) is a bearing sleeve having a central longitudinal axis substantially normal to the direction in which the spaced apart members (12) extend.

7. A tine construction as claimed in claim 6 wherein the spaced apart members (12) are respectively each coupled by one end to opposite sides of the tine (11) and the other end of each said member is coupled to the bearing sleeve (13).

* * * * *